US005596923A

United States Patent [19]

Enami

[11] Patent Number: 5,596,923

[45] Date of Patent: Jan. 28, 1997

[54] PRESS WORKING MACHINE

[75] Inventor: Toshiaki Enami, Kyoto, Japan

[73] Assignee: Enami Seiki Mfg. Co., Ltd., Yao, Japan

[21] Appl. No.: 633,570

[22] Filed: Apr. 17, 1996

[30] Foreign Application Priority Data

May 25, 1995 [JP] Japan ..... 7-126838

[51] Int. Cl.[6] ..... B30B 15/16; B30B 1/08

[52] U.S. Cl. ..... 100/53; 100/271

[58] Field of Search ..... 100/48, 53, 270, 100/271

[56] References Cited

U.S. PATENT DOCUMENTS 2,162,133 6/1939 Spire ..... 100/271

2,443,573 6/1948 Brundage ..... 100/271

FOREIGN PATENT DOCUMENTS 649582 1/1951 United Kingdom ..... 100/271

*Primary Examiner*—Stephen F. Gerrity

*Attorney, Agent, or Firm*—W. G. Fasse; W. F. Fasse

[57] ABSTRACT

In the press working machine, a first working plate is downwardly moved by a rod of an air cylinder. At this time, the lower end of a lock pin is in contact with a horizontal plane, whereby the first working plate is rotated about a second rotation axis. Thus, a first rotation axis is upwardly rotated about the second rotation axis, to further upwardly move a lower mold base. At this time, a lower mold and an upper mold are already in contact with each other, whereby a high thrust is caused between the molds to enable molding/joining of metal plates or the like. Consequently, it is possible to provide a press working machine which can embody both of a low-thrust/high-speed area and a high-thrust/low-speed area through only a single air cylinder.

1 Claim, 14 Drawing Sheets

[PROCESS I]

[PROCESS I]

[PROCESS II]

[PROCESS III]

[PROCESS IV]

[PROCESS V]

[PROCESS VI]

[PROCESS VII]

[PROCESS VIII]

[PROCESS IX]

PNEUMATIC THRUST STROKE DRIVING

HIGH THRUST STROKE DRIVING

PRESS WORKING MACHINE

BACKGROUND OF THE INVENTION

1. Field of the Invention

The present invention relates to a press working machine, and more specifically, it relates to a press working machine which can be readily employed for molding/joining metal plates, press-fitting/assembling machine parts, and the like.

2. Description of the Background Art

There have generally been made various proposals in relation to a method of embodying an area (low-thrust/high-speed area) requiring a high speed with a moderate thrust and an area (high-thrust/low-speed area) requiring a high thrust with a moderate speed through a press working machine which is supplied with only an air pressure serving as driving force therefor.

FIGS. 11 to 14 show a press working machine of a system utilizing the principle of a pressure intensifier (air hydraulic booster) for obtaining a hydraulic pressure which is intensified by the ratio of an area of an air cylinder to that of a piston, for example.

In a pullback position shown in FIG. 11, a main valve (a) is switched to supply air to a piston chamber (b), while discharging air from the piston chamber (c). Thus, a working piston 31 is moved to a position shown in FIG. 12 at a low thrust and a high speed.

After this high-speed movement process of the working piston 31, a feed piston 33 which is driven by a spring 42 feeds oil from an accumulator 41 to a high-pressure chamber 35 under pressure. Thus, a pneumatic valve (d) is started by the resistance, to introduce compressed air into a booster piston chamber (e).

Thereafter a plunger 33 of a booster piston 32 passes through the high-pressure chamber 35 as shown in FIG. 13 to divide the high-pressure chamber 35 into a working area and an oil accumulator, and compresses the oil in the working area to a constant high pressure.

Thereafter the working piston 31 is supplied with a high-thrust stroke due to displacement of the oil by the plunger 33, as shown in FIG. 14. In this press working machine, the working piston 31 is moved by a distance which is proportionate to the volume of the displaced oil.

In a return stroke, the main control valve (a) is so switched that the pneumatic valve (d) automatically ventilates the chamber (e), and the working piston 31 and the booster piston 32 are immediately returned to the initial positions shown in FIG. 11.

FIGS. 15 to 17 show another press working machine utilizing a converter.

In this press working machine, a port $P_3$ first sucks air in the state shown in FIG. 15, to advance a hydraulic piston 50 through a hydraulic pressure converter 48 in a rapid traverse manner. Then, air is supplied through a port $P_1$ to advance a booster piston 51 at a high thrust by a hydraulic pressure which is intensified by the Pascal's principle (twice the pneumatic booster ratio) as shown in FIG. 16.

Then, air is supplied through ports $P_2$ and $P_4$ while the remaining ones are converted to discharging states as shown in FIG. 17, whereby both of the hydraulic piston 50 and the booster piston 51 recover to the initial states shown in FIG. 15 at a high speed.

However, each of the aforementioned conventional press working machines obtaining high thrusts through hydraulic pressures has the following problems:

(1) The pressure obtained in the pressure intensifying process is limited due to dependence on the Pascal's principle. Namely, the maximum reachable thrust is about 40 tons, since the cylinder area ratio is about 1:40 at the most.

In order to attain a higher thrust, further, it is necessary to increase the inner diameter of the air cylinder to at least 100 mm. Thus, the volume of consumed air is extremely increased.

(2) The inner diameter of the air cylinder exceeds 100 mm as described above, and hence the apparatus is increased in scale due to the large cylinder dimensions.

(3) In order to attain a high thrust, an air pressure of 5 to 10 kgf/cm$^2$ is necessary. Thus, it is necessary to intensity a supplied air pressure (up to 5 kgf/cm$^2$) which is employed in an ordinary factory.

SUMMARY OF THE INVENTION

An object of the present invention is to provide a press working machine which can embody both of a low-thrust/high-speed area and a high-thrust/low-speed area through only a single air cylinder having a single cylinder sectional area.

A press working machine according to the present invention comprises a frame having a prescribed reference plane spreading out in the vertical direction, an upper mold base which is fixedly provided on the reference plane for fixing an upper mold, a guide rail which is provided on the reference plane under the upper mold base along the vertical direction, a lower mold base for fixing a lower mold which is slidable in the vertical direction along the guide rail, a first side wall which is provided on the lower end portion of the reference plane at a first distance with respect to the reference plane, for defining a groove portion along with the reference plane, a horizontal plane which is provided in an opposite direction to the reference plane to be continuous from the upper end of the first side wall, a second side wall which is provided on the horizontal plane in a position separated from the reference plane by a second distance which is larger than the first distance in the vertical direction with respect to the horizontal plane, a first working plate having an end which is rotatably mounted on the lower mold base about a first rotation axis, an air cylinder which is mounted on the other end of the first working plate for rotating the first working plate about the first rotation axis, a second working plate which is rotatably mounted with respect to the first working plate about a second rotation axis which is provided on a side closer to the reference plane than the first rotation axis and the second working plate which is provided on its another end with an insertion member receivable in the groove portion, urge device which is mounted on the insertion member of the second working plate to be movable between a first position for coming into contact with the reference plane and supplying urging force to the second working plate for separating the same from the reference plane and a second position canceling the urging force, a first engaging member which is mounted on the first working plate for moving the urge device from the first position to the second position following rotation of the first working plate the in a state upwardly positioning the lower mold base, and a second engaging member for moving the urge device from the second position to the first position, and a conversion member which is mounted on a prescribed position under the reference plane for converting the first and second positions of the urge device following vertical movement of the second working plate in a state downwardly positioning the lower mold base.

In the press working machine having the aforementioned structure, the first working plate is upwardly moved by the air cylinder at a high speed from a first state where the lower mold base is positioned in the lowermost point and the insertion member of the second working plate is inserted in the groove portion. Following such upward movement of the first working plate, the lower mold base and the second working plate are simultaneously upwardly moved at a high speed. The lower mold which is mounted on the lower mold base comes into contact with the upper mold which is mounted on the upper mold base. At this time, the insertion member is disengaged from the groove portion, and moved by the urge device in a direction to be separated from the reference plane. The lower end of the insertion member is moved along the horizontal plane, and stopped when the same comes into contact with the second side wall.

Then, the first working plate is downwardly moved by the air cylinder. The lower end of the insertion member is in contact with the horizontal plane at this time, whereby the first working plate is rotated about the second rotation axis. Consequently, the first rotation axis is upwardly rotated about the second rotation axis, to further move up the lower mold base. However, the lower mold is in contact with the upper lower mold, whereby a high thrust is developed between the molds, thereby enabling molding/joining of metal plates or the like.

Thus, it is possible to embody both of a low-thrust/high-speed area and a high-thrust/low-speed area through a single air cylinder.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
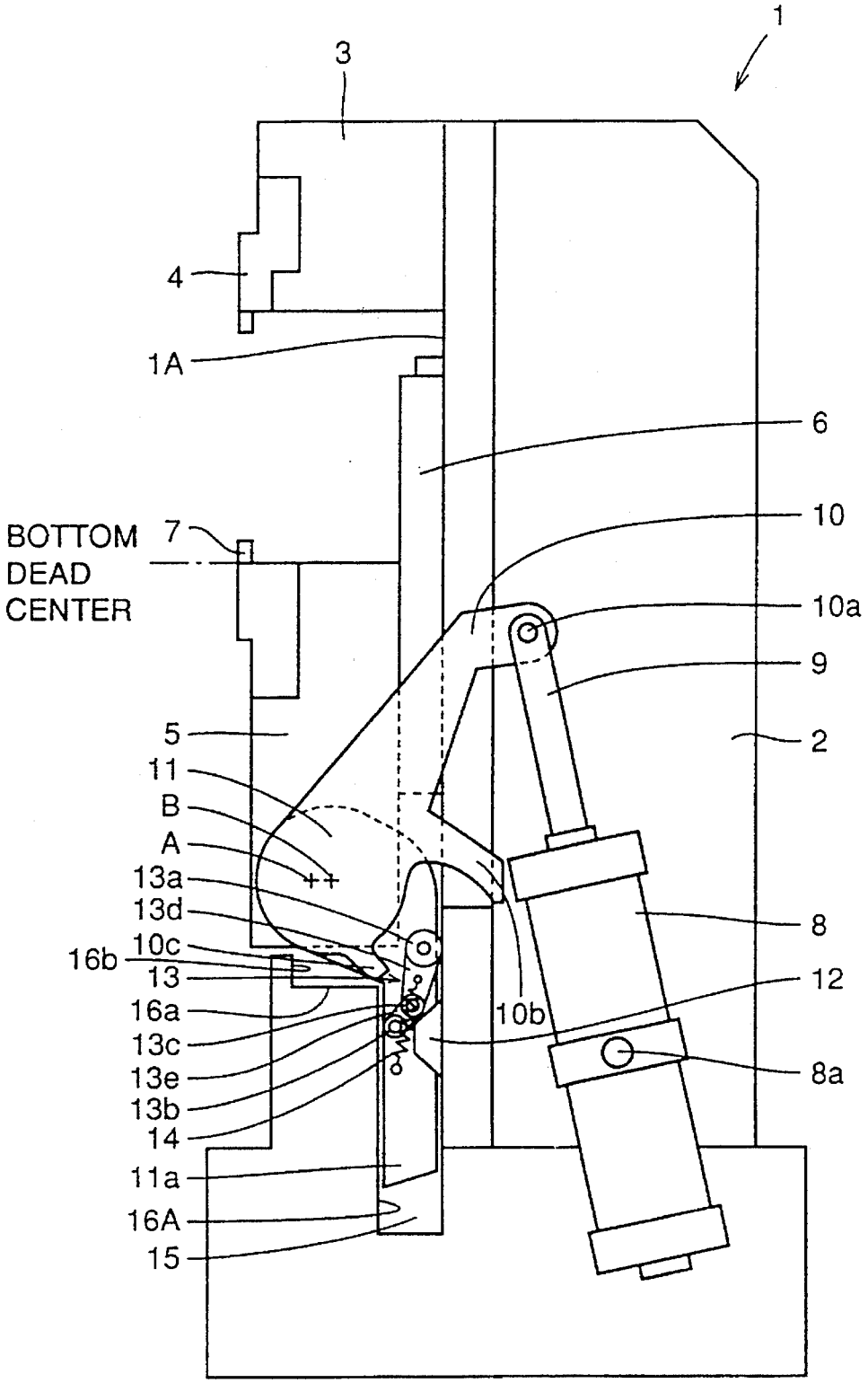
FIG. 1 illustrates the structure of a press working machine according to an embodiment of the present invention, which is in a first pressing process.

An embodiment of a press working machine according to the present invention is now described with reference to FIG. 1.

This press working machine 1 comprises a frame 2 having a reference plane 1A which spreads out in the vertical direction. An upper mold base 3 for fixing an upper mold 4 is mounted on the reference plane 1A on the upper end portion of the frame 2.

On the other hand, a guide rail 6 is provided on the reference plane 1A under the upper mold base 3 along the vertical direction, while a lower mold base 5 is provided to be movable along the guide rail 6. A lower mold 7 is mounted on the lower mold base 5, in a position facing the upper mold 4 of the upper mold base 3.

On the lower end portion of the reference plane 1A, a first side wall 16A is formed at a prescribed distance from the reference plane 1A. Thus, a guide groove 15 is defined by the lower end portion of the reference plane 1A and the first side wall 16A. On the upper end portion of the first side wall 16A, further, a horizontal plane 16*a* is formed to be continuous from the upper end portion of the first side wall 16A and separated from the reference plane 1A. In addition, a second side wall 16*b* is provided on a position of the horizontal plane 16*a* separated from the reference plane 1A by a prescribed distance, vertically along the horizontal plane 16*a*.

A first working plate 10 is mounted on the lower mold base 5, so that an end thereof is rotatable about a first rotation axis A with respect to the lower mold base 5. A rod 9 of an air cylinder 8 is mounted on another end of the first working plate 10, to be rotatable about a shaft 10*a* for rotating the first working plate 10 about the first rotation axis A. Further, the air cylinder 8 is mounted on the frame 2 to be rotatable about a rotation axis 8*a*.

The first working plate 10 is provided with a second working plate 11 to be rotatable with respect to the first working plate 10 about a second rotation axis B, which is provided in the vicinity of the first rotation axis A on the reference plane 1A side. The second working plate 11 is provided with a lock pin 11*a* which is receivable in the guide groove 15. This lock pin 11*a* is provided with a guide roller 13, which comes into contact with the reference plane 1A to supply the second working plate 11 with urging force for separating the same from the reference plane 1A.

In this guide roller 13, a first roller 13*a* which is rotated while being in contact with the reference plane 1A is mounted on a first plate 13*d*, and a second roller 13*b* which is rotated along a conversion member 12 mounted on a prescribed position under the reference plane 1A is mounted on a second plate 13*e* on an opposite side. The first and second plates 13*d* and 13*e* are mounted on the lock pin 11*a* to be rotatable about a shaft portion 13*c* for forming a prescribed angle with each other. A spring 14 is mounted between the first plate 13*d* and the lock pin 11*a*, to press the first roller 13*a* against the reference plane 1A in the state shown in FIG. 1.

The first working plate 10 is further provided with first engaging pins 10*b* and 10*c* in prescribed positions, for converting the state of the guide roller 13.

The pressing operation of the press working machine 1 having the aforementioned structure is now described with reference to FIGS. 1 to 9. First, the lower mold base 5 is in a state (hereinafter referred to as "bottom dead center state") located at the lowermost position, so that the lock pin 11*a* is inserted in the guide groove 15. This process is called a process I.

Figure 2:
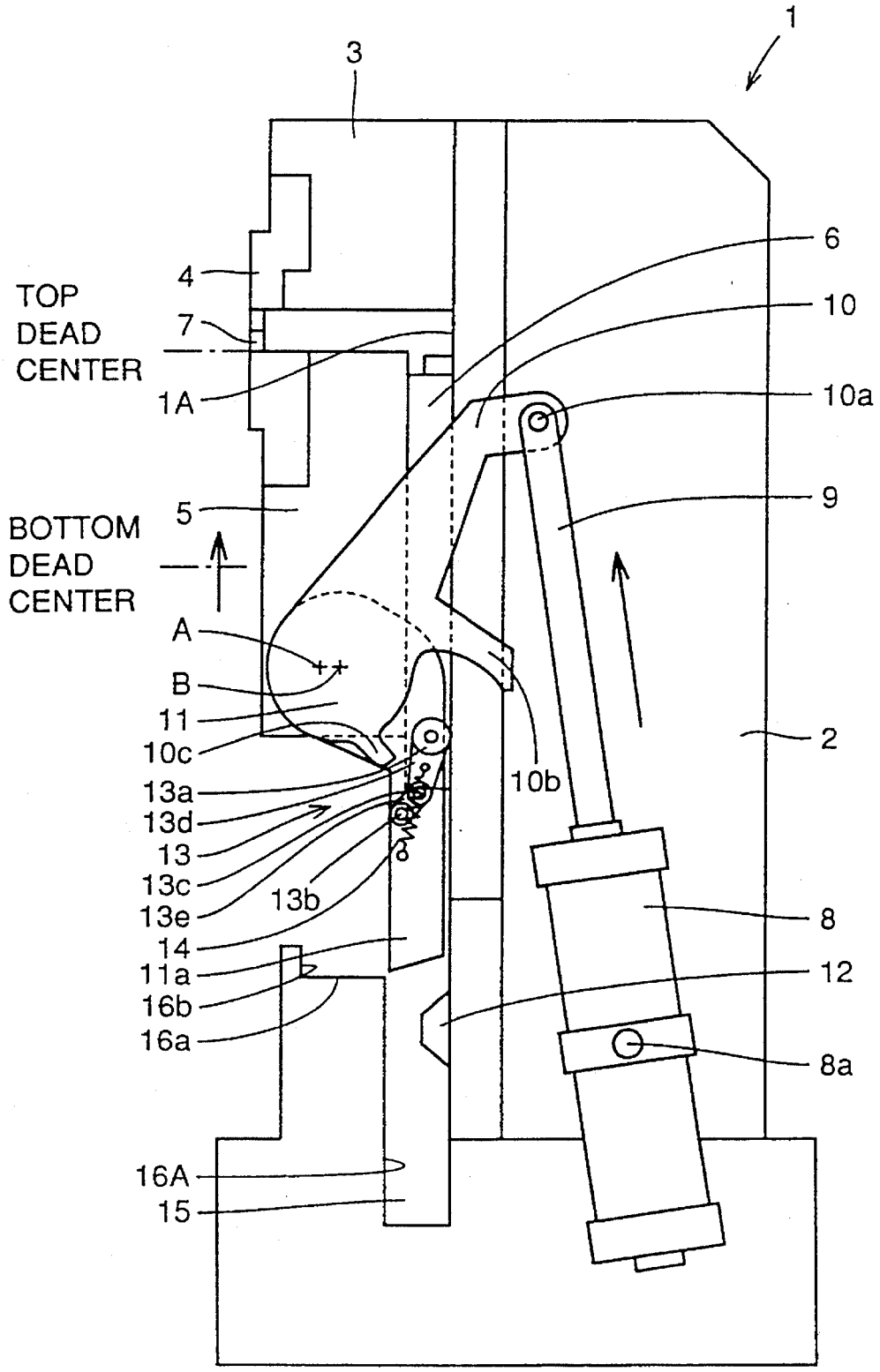
FIGS. 2 to 9 illustrate second to ninth pressing processes of the press working machine according to the embodiment of the present invention.

Referring to FIG. 2, the rod 9 is then upwardly moved through the air cylinder 8. Thus, the lower mold base 5 and the first and second working plates 10 and 11 are also upwardly moved.

Due to such upward movement, the lower mold base 5 is located at the uppermost position in a low-thrust/high-speed stroke. Further, the lock pin 11*a* is disengaged from the guide groove 15. This process is called a process II.

Figure 3:
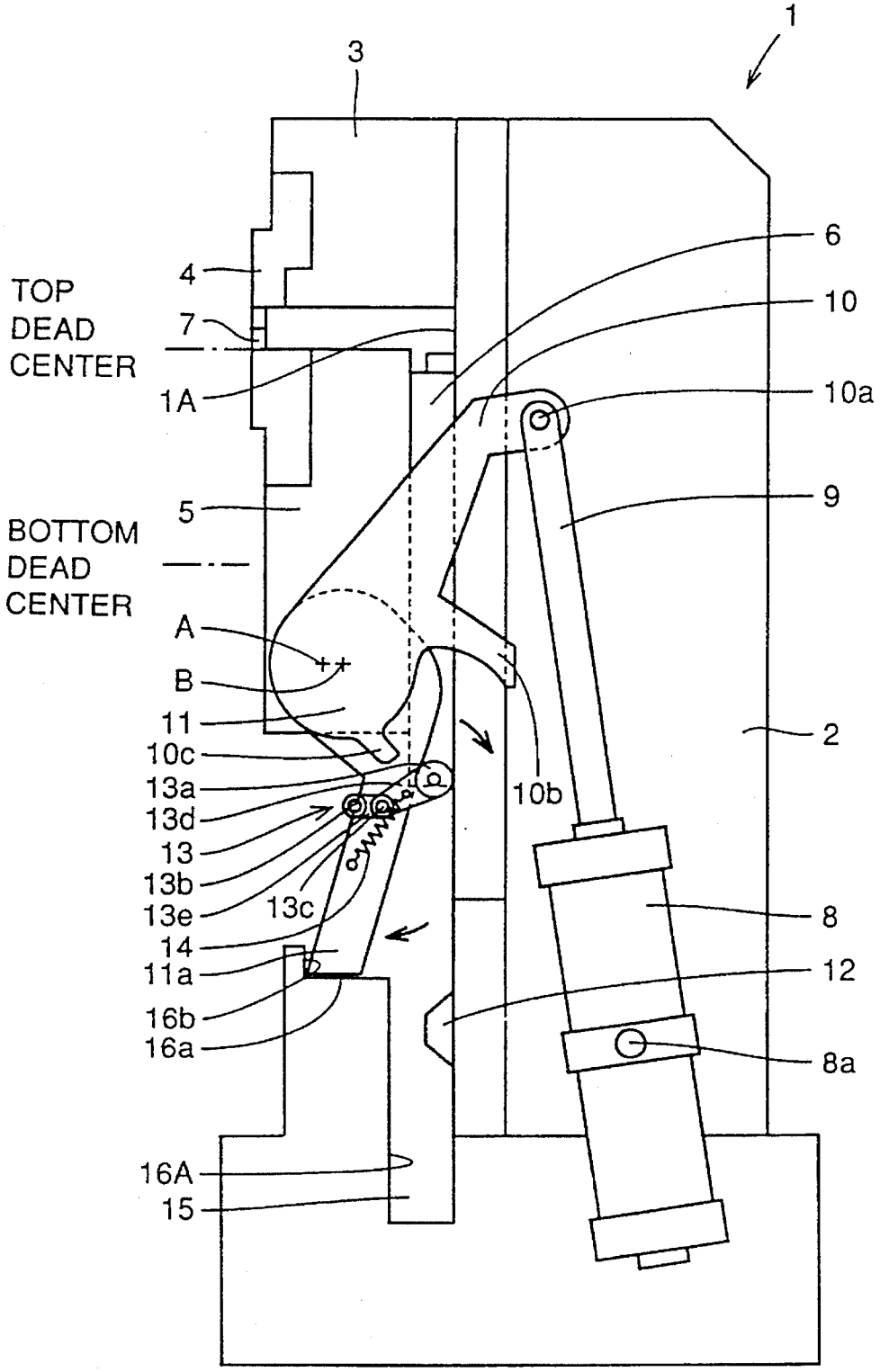

Referring to FIG. 3, the lock pin 11*a* which is disengaged from the guide groove 15 is rotated clockwise about the second rotation axis B due to action of the guide roller 13, so that its lower end comes into contact with the second side wall 16*b*. This process is called a process III.

Figure 4:
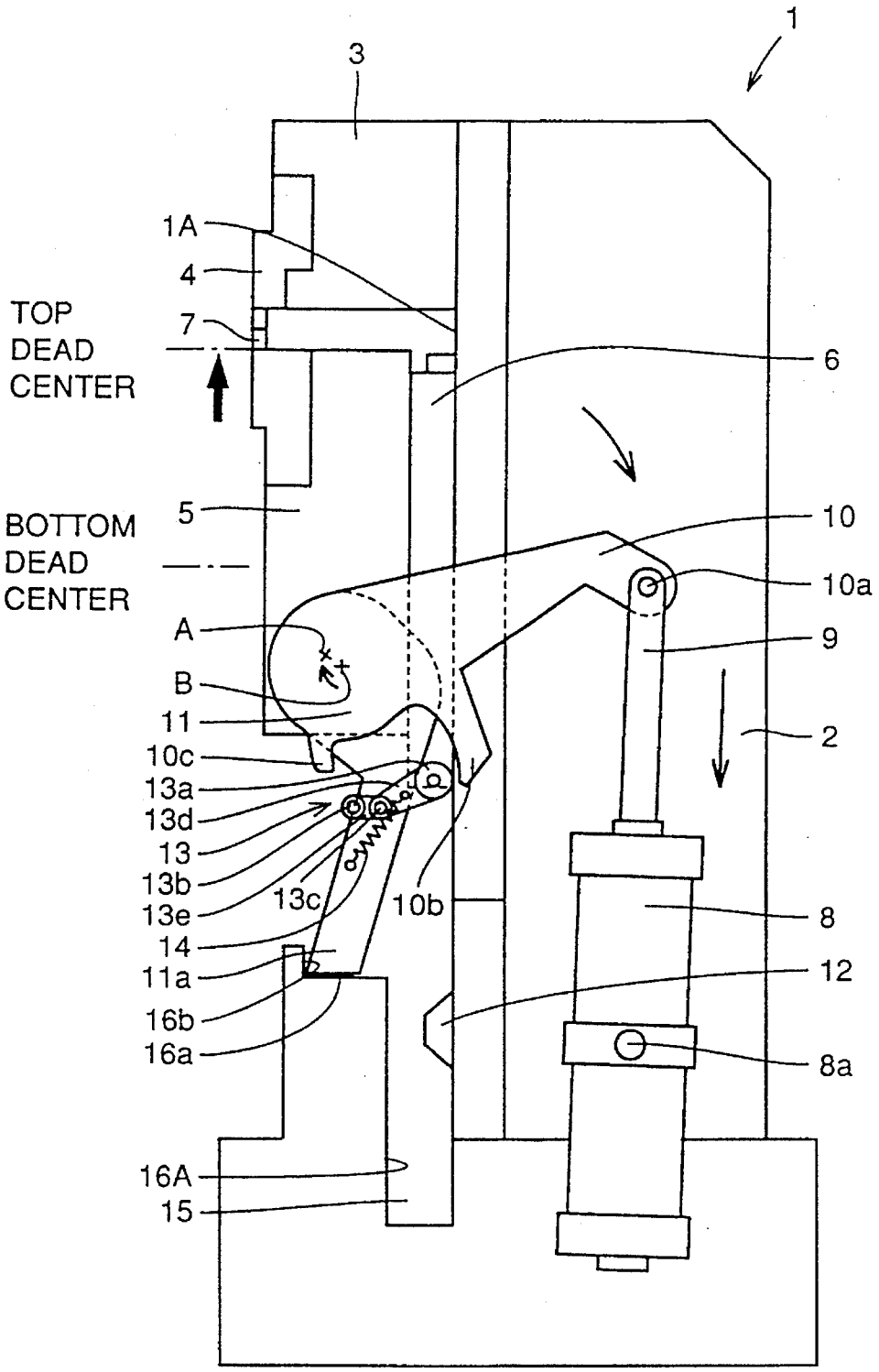

Referring to FIG. 4, the rod 9 is downwardly moved by the air cylinder 8. The lower end of the lock pin 11*a* is in contact with the horizontal plane 16*a* at this time as described above, whereby the first working plate 10 is rotated about the second rotation axis B. Consequently, the first rotation axis A is upwardly rotated about the second rotation axis B, to further move up the lower mold base 5 to a top dead center. When the lower mold 7 comes into contact with the upper mold 4, a high thrust is developed between the upper and lower molds 4 and 7 due to leverage which is based on eccentricity of the first and second rotation axes A and B, thereby enabling molding/joining of metal plates or the like in this state. This process is called a process IV.

Figure 5:
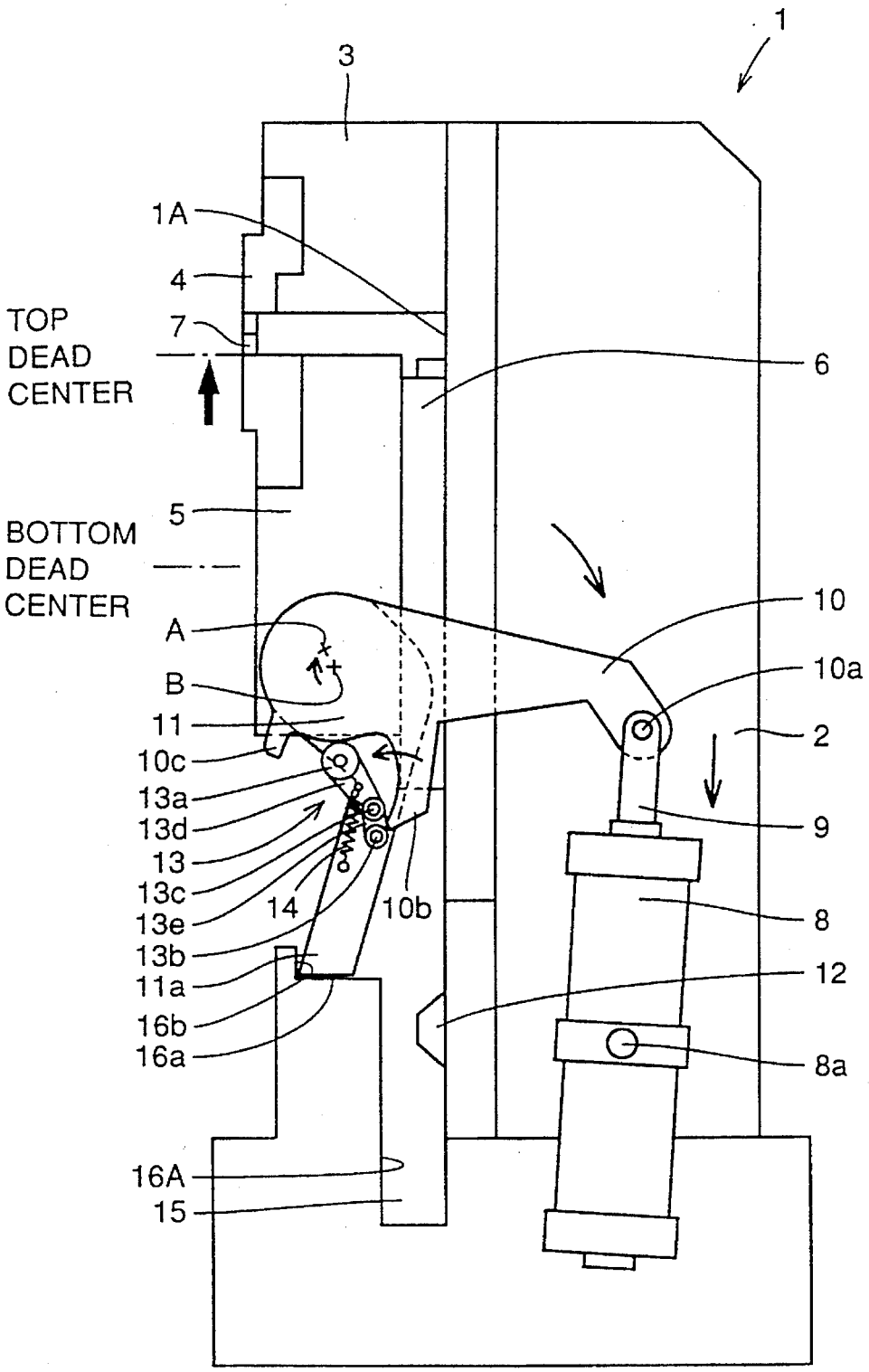

Referring to FIG. 5, the rod 9 is further downwardly moved by the air cylinder 8, to develop a high thrust between the upper and lower molds 4 and 7. At this time, the first engaging pin 10*b* which is provided on the first working plate 10 is rotated while being engaged with the first roller 13*a* of the guide roller 13, thereby converting the state of the guide roller 13. Thus, the guide roller 13 is stopped in a state inclined oppositely to the reference plane 1A by the spring 14, as shown in FIG. 5. This process is called a process V.

Figure 6:
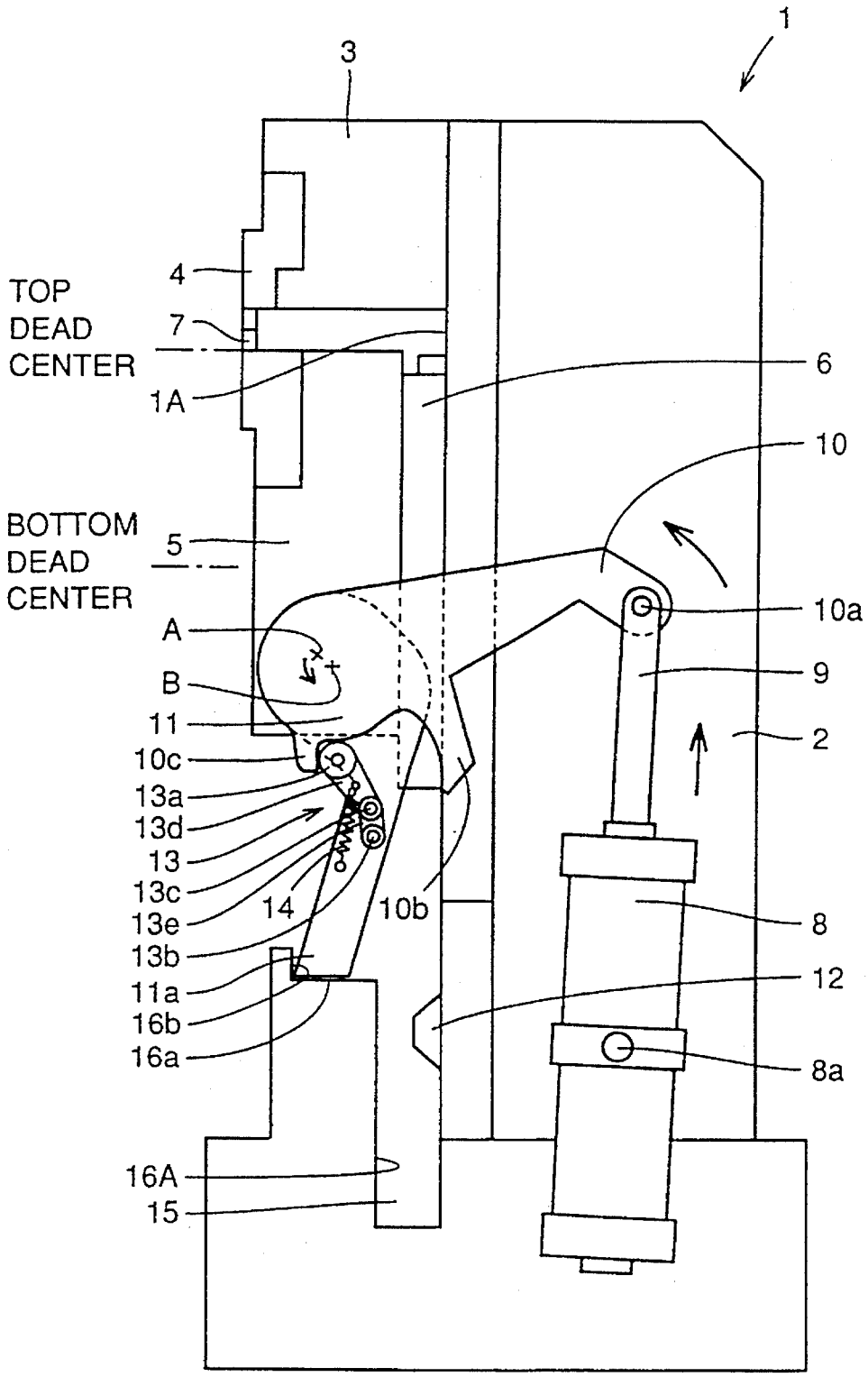

Referring to FIG. 6, the rod 9 is upwardly moved by the air cylinder 8, to bring the second engaging pin 10*c* which is provided on the working plate 10 into contact with the first roller 13*a* of the guide roller 13. At this time, the force of the spring 14 maintaining the current state is stronger than that of the second engaging pin 10*c* inclining the guide roller 13 about the shaft portion 13*c*, whereby rotation of the second working plate 11 is started in this state along with rotation of the first working plate 10. This process is called a process VI.

Figure 7:
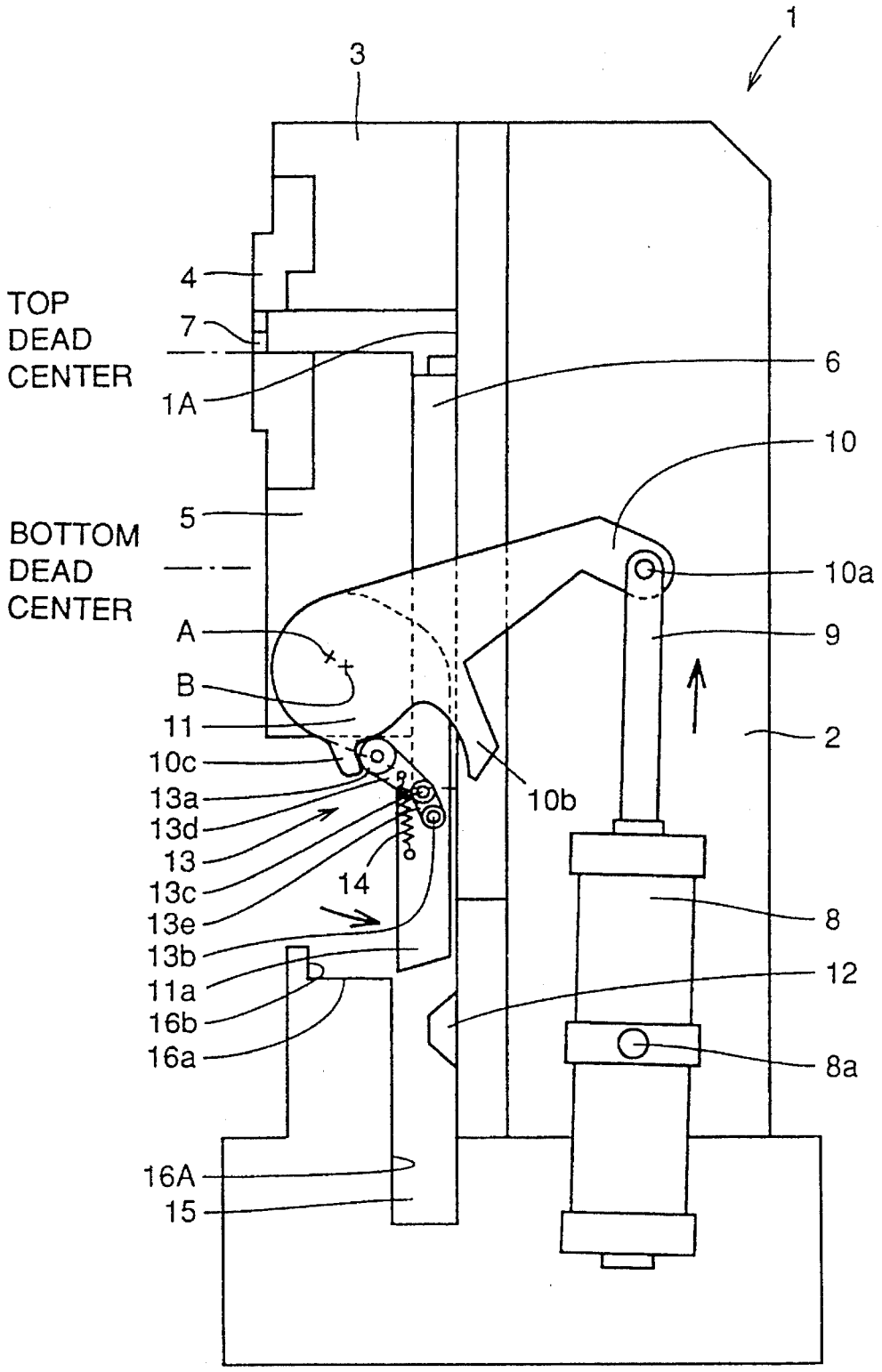

Referring to FIG. 7, the rod 9 is further upwardly moved by the air cylinder 8 to rotate the first and second working plates 10 and 11 anticlockwise until the lock pin 11*a* is parallel to the reference plane 1A. This process is called a process VII.

Figure 8:
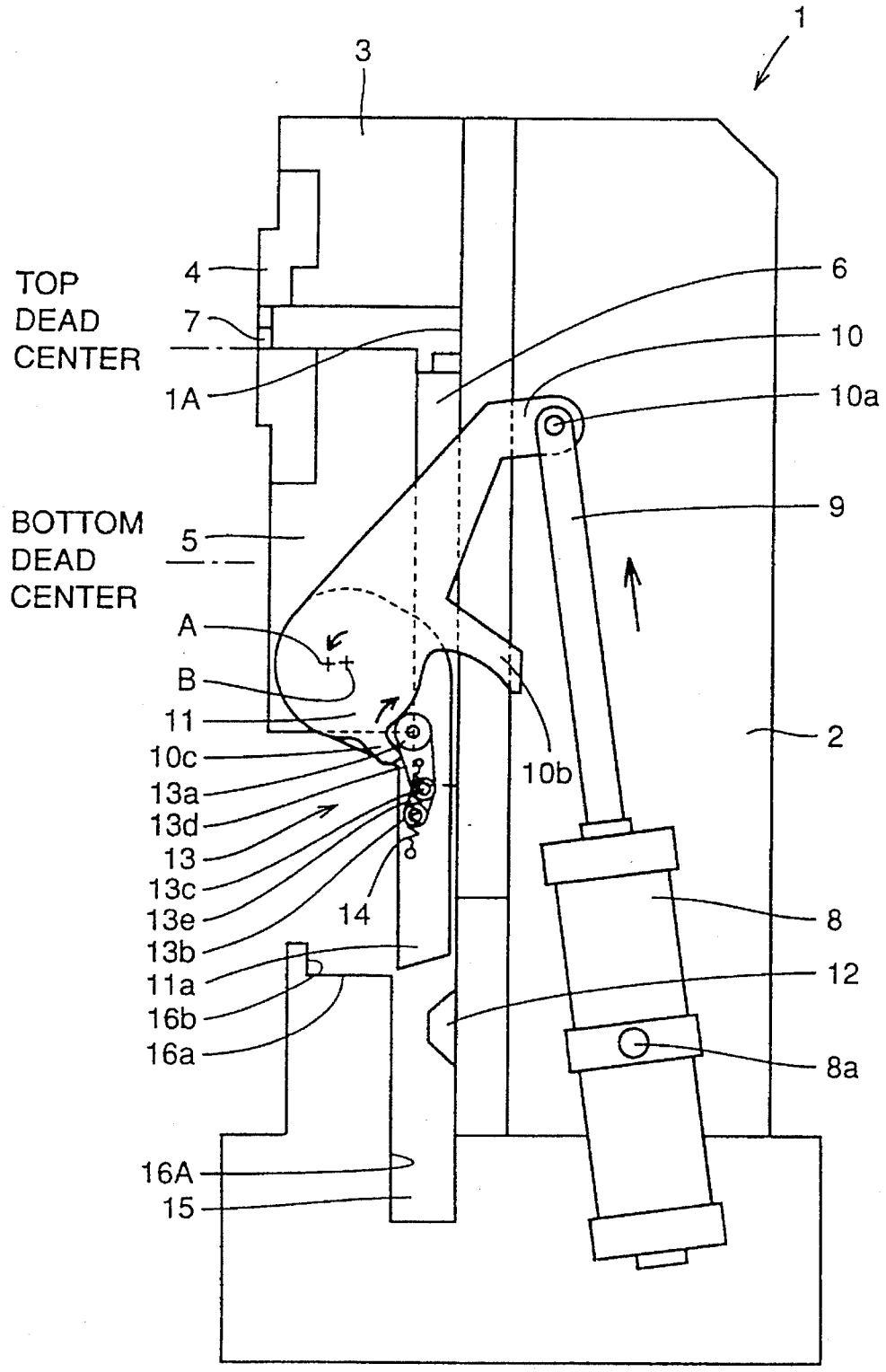

Referring to FIG. 8, the rod 9 is further upwardly moved by the air cylinder 8, to rotate the first working plate 10. At this time, the second working plate 11 cannot be further rotated since the lock pin 11*a* comes into contact with the reference plane 1A, whereby the guide roller 13 is displaced by the second engaging pin 10*c* about the shaft portion 13*c* so that the spring 14 is substantially along the vertical direction, due to the rotation of the first working plate 10. This process is called a process VIII.

Figure 9:
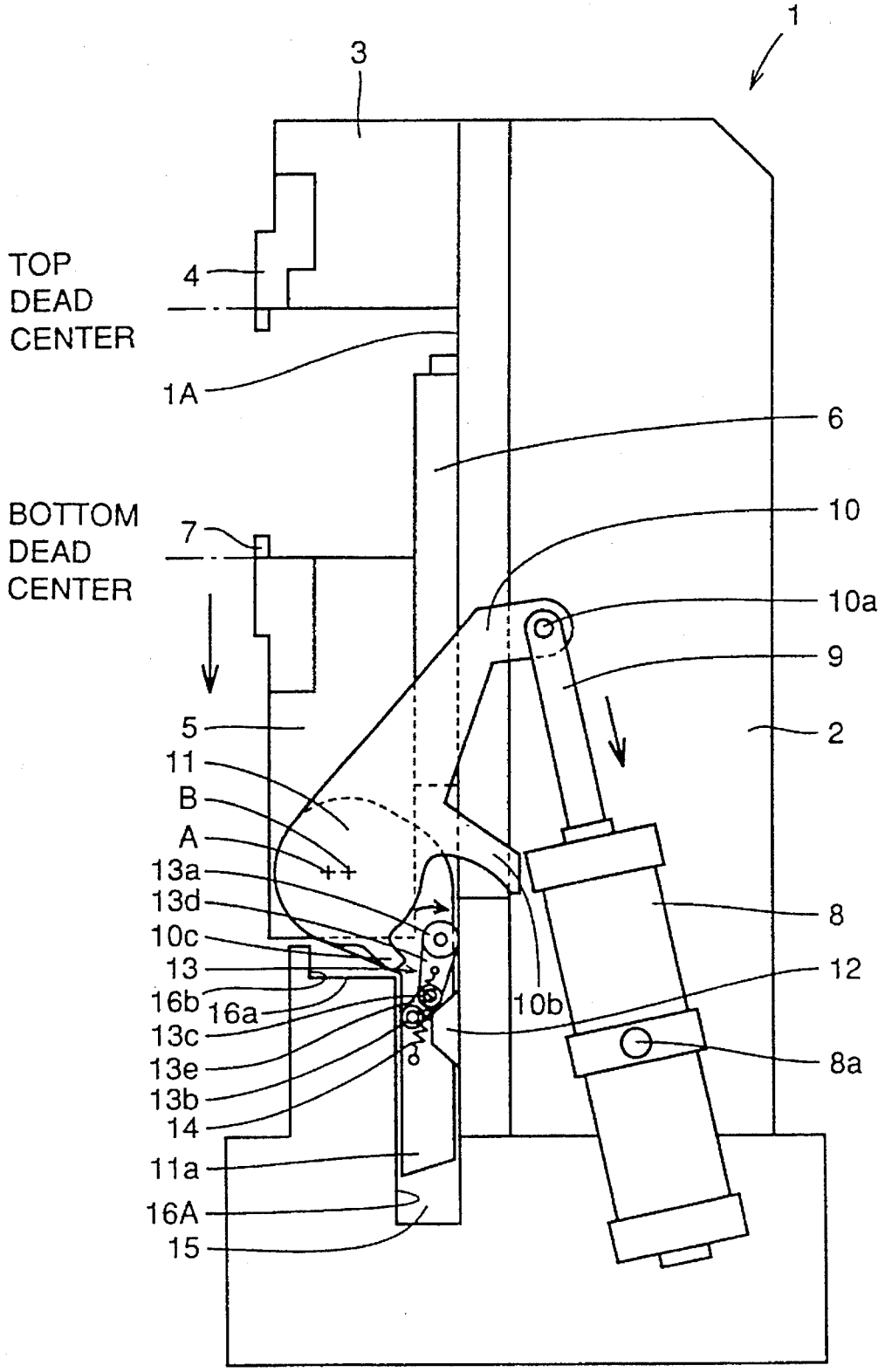
Figure 10:
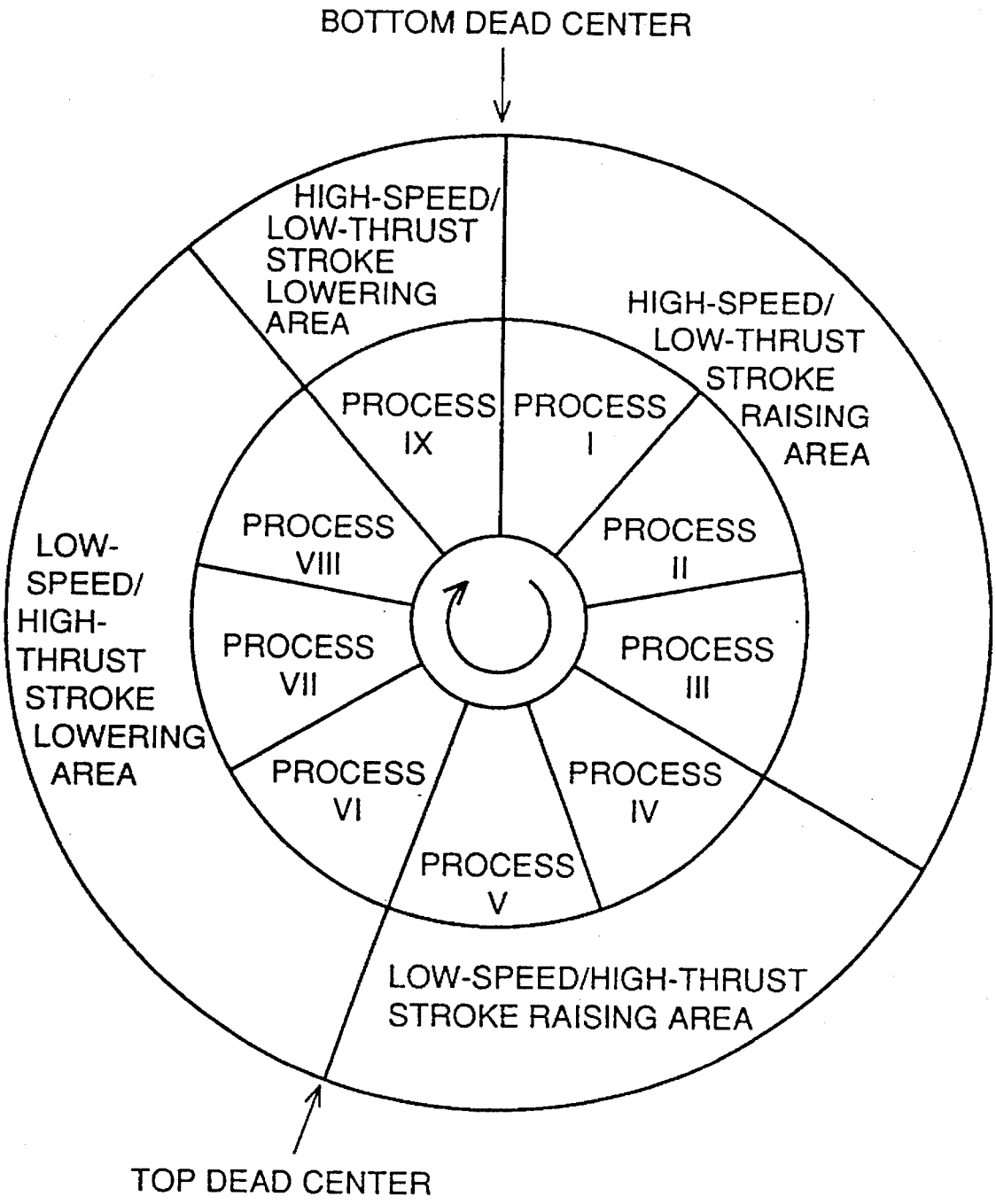
FIG. 10 is a process diagram of the press working machine according to the embodiment of the present invention.
Figure 11:
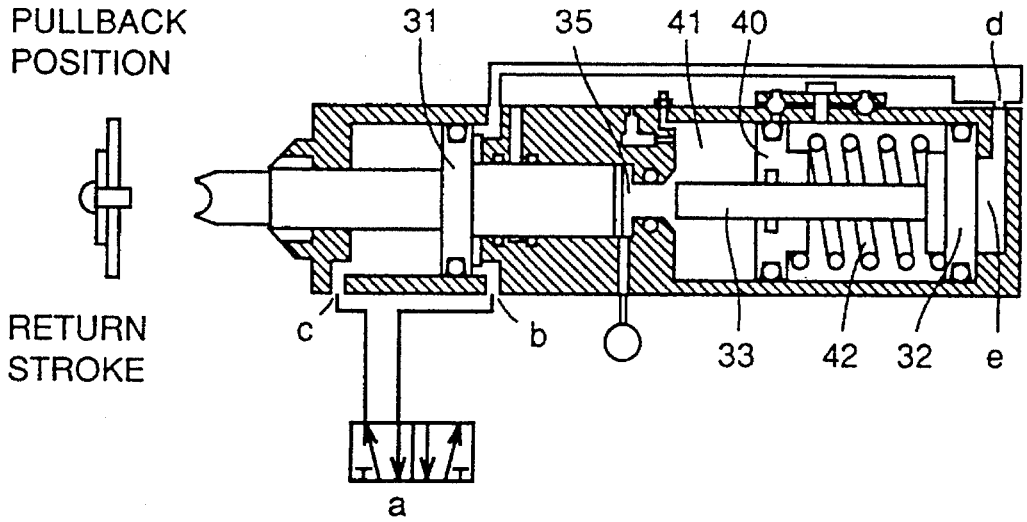
FIG. 11 PRIOR ART
FIG. 11 illustrates a first process of a press working machine according to first prior art.
Figure 12:
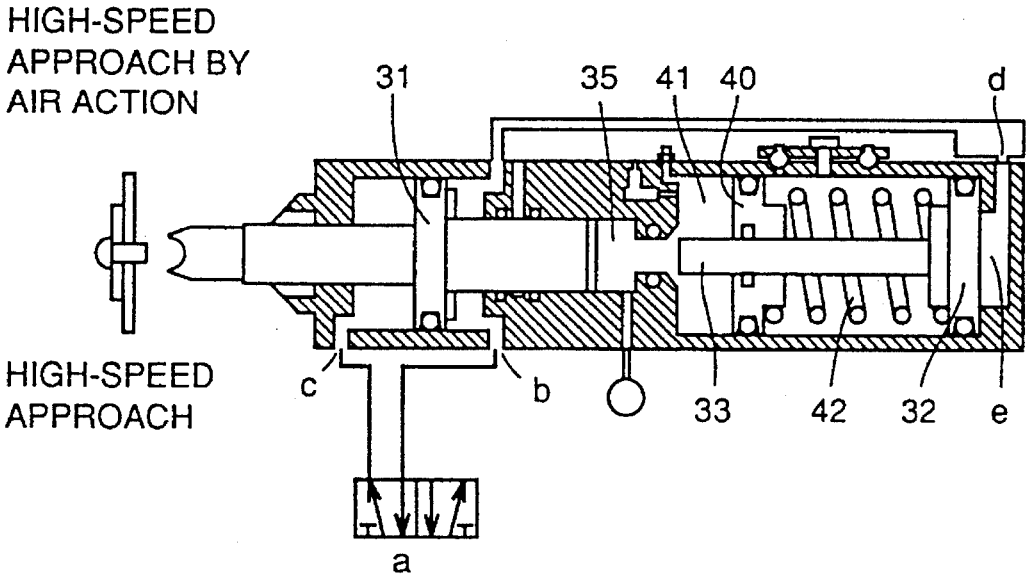
FIG. 12 PRIOR ART
FIGS. 12 to 14 illustrate second to fourth processes of the press working machine according to the first prior art.
Figure 13:
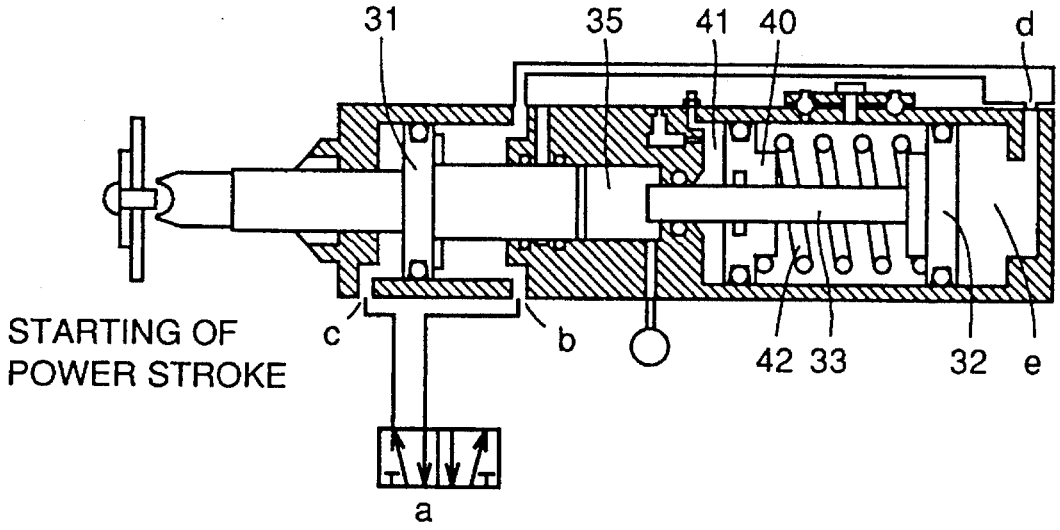
FIG. 13 PRIOR ART
Figure 14:
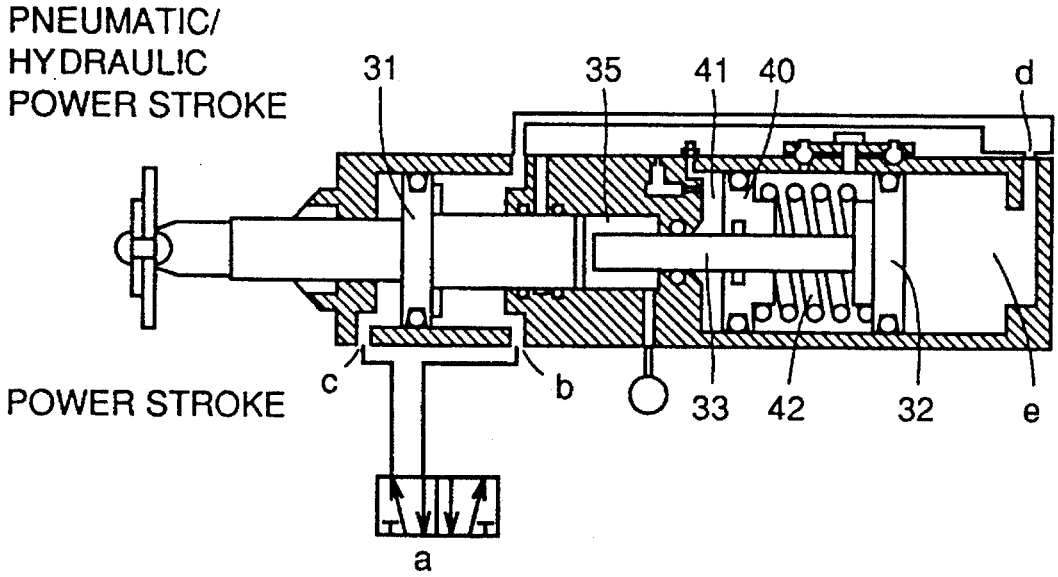
FIG. 14 PRIOR ART
Figure 15:
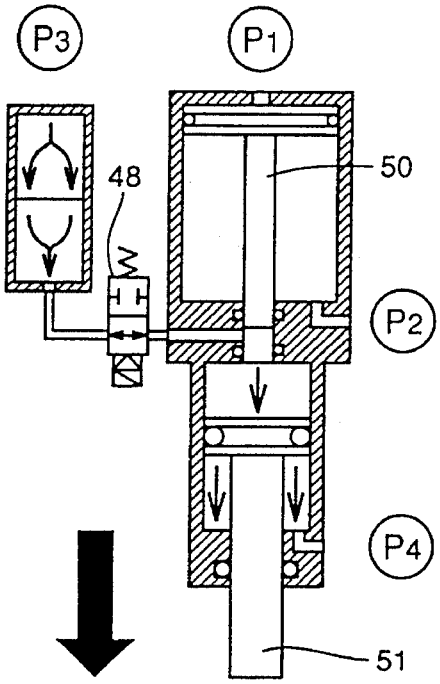
FIG. 15 PRIOR ART
FIGS. 15 to 17 illustrate first to third processes of a press working machine according to second prior art.
Figure 16:
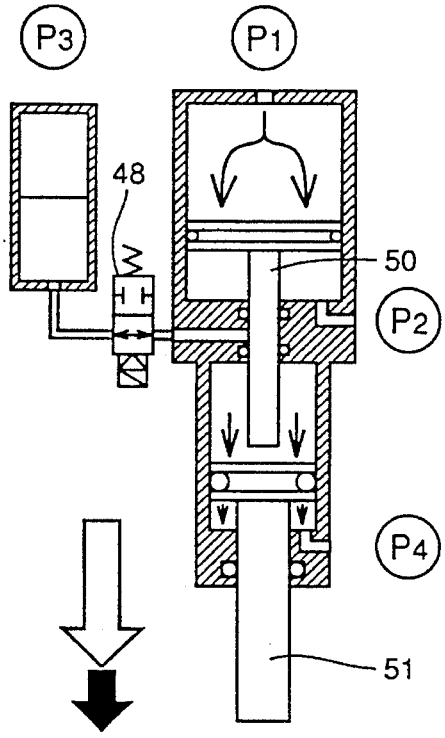
FIG. 16 PRIOR ART
Figure 17:
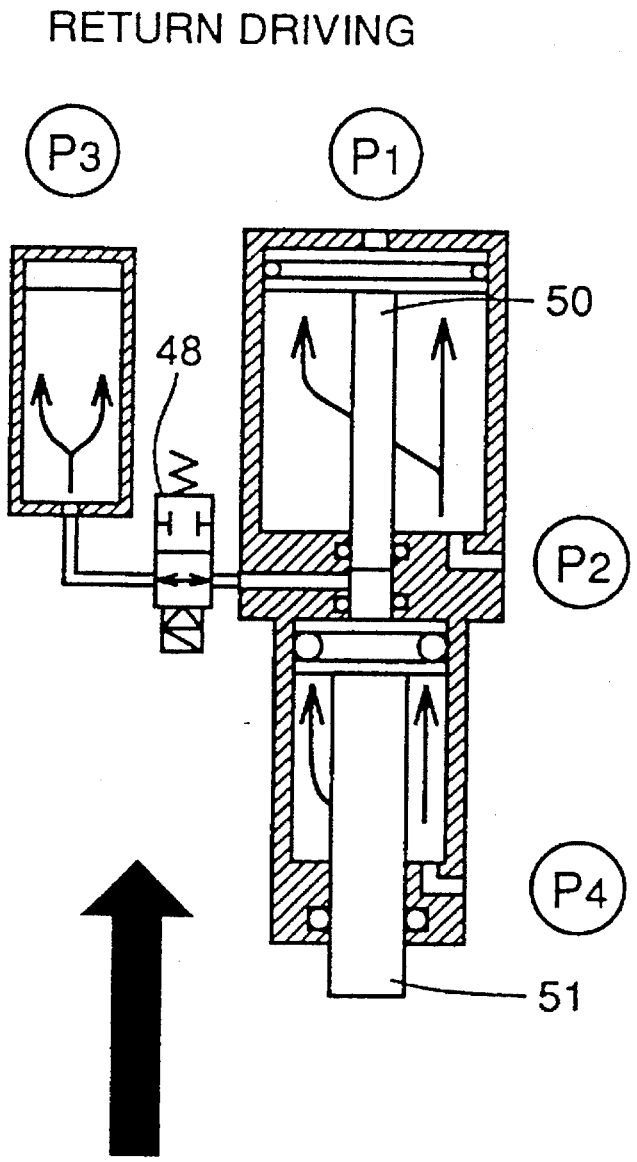
FIG. 17 PRIOR ART

Referring to FIG. 9, the rod 9 is downwardly moved by the air cylinder 8, to insert the lock pin 11a in the guide groove 15. Also at this time, the second roller 13*b* of the guide roller 13 comes into contact with the conversion member 12 which is provided on the reference plane 1A, to rotate the guide roller 13 clockwise about the shaft portion 13*c*, thereby displacing the guide roller 13 into the same state as the process I shown in FIG. 1. This process is called a process IX.

Thus, the series of operations of the press working machine according to this embodiment are completed.

Among the processes I to IX shown in FIGS. 1 to 9, the processes I to III define a high-speed/low-thrust stroke raising area and the processes IV to V define a low-speed/high-thrust stroke raising area, while the processes VI to VIII define a low-speed/high-thrust stroke lowering area and the process IX defines a high-speed/low-thrust stroke lowering area.

According to this embodiment, as hereinabove described, two areas including a low-thrust/high-speed area and a high-thrust/low-speed area can be formed through a single air cylinder. Thus, it is possible to provide a press working machine having a high thrust with a supplied air pressure which is employed in an ordinary factory, for example.

In the press working machine having the aforementioned structure, two areas including a low-thrust/high-speed area and a high-thrust/low-speed area can be embodied with a single air cylinder. Consequently, it is possible to provide a press working machine having a high thrust of at least 50 tons with a single cylinder while utilizing a supplied air pressure of about 5 $kgf/cm^2$ which is employed in an ordinary factory.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A press working machine comprising:

a frame having a prescribed reference plane spreading out in the vertical direction;

an upper mold base being fixedly provided on said reference plane for fixing an upper mold;

a guide rail being provided on said reference plane under said upper mold base along the vertical direction;

a lower mold base for fixing a lower mold being slidable in the vertical direction along said guide rail;

a first side wall being provided on the lower end portion of said reference plane at a first distance with respect to said reference plane, for defining a groove portion along with said reference plane;

a horizontal plane being provided in an opposite direction to said reference plane to be continuous from the upper end of said first side wall;

a second side wall being provided on said horizontal plane in a position separated from said reference plane by a second distance being larger than said first distance in the vertical direction with respect to said horizontal plane;

a first working plate having an end being rotatably mounted on said lower mold base about a first rotation axis;

an air cylinder being mounted on the other end of said first working plate for rotating said first working plate about said first rotation axis;

a second working plate being rotatably mounted with respect to said first working plate about a second rotation axis being provided on a side closer to said reference plane than said first rotation axis, said second working plate being provided on its another end with an insertion member being receivable in said groove portion;

urge means being mounted on said insertion member of said second working plate to be movable between a first position for coming into contact with said reference plane and supplying urging force to said second working plate for separating the same from said reference plane and a second position canceling said urging force;

a first engaging member being mounted on said first working plate for moving said urge means from said first position to said second position following rotation of said first working plate in a state upwardly positioning said lower mold base, and a second engaging member for moving said urge means from said second position to said first position; and a conversion member being mounted on a prescribed position under said reference plane for converting said first and second positions of said urge means following vertical movement of said second working plate in a state downwardly positioning said lower mold base.

* * * * *